US005762236A

United States Patent [19]

Foster et al.

[11] Patent Number: 5,762,236

[45] Date of Patent: Jun. 9, 1998

[54] IMPROVED TRIGGER MECHANISM FOR TRIGGER SPRAYER

[75] Inventors: Donald D. Foster, St. Charles; Tom L. Wilcox, St. Louis; George Hildebrand, O'Fallon, all of Mo.

[73] Assignee: Contico International, Inc., St. Louis, Mo.

[21] Appl. No.: 586,401

[22] Filed: Jan. 16, 1996

[51] Int. Cl.[6] ..... B67D 5/42

[52] U.S. Cl. ..... 222/383.1

[58] Field of Search ..... 222/324, 383.1, 222/321.8; 239/333, 526; D9/300, 443, 448; D23/223, 226, 225

[56] References Cited

U.S. PATENT DOCUMENTS

| | | | |
|---|---|---|---|
| D. 183,070 | 6/1958 | Stillson . | |
| D. 274,794 | 7/1984 | Witte . | |
| 418,469 | 12/1889 | McKinley | 222/383.1 |
| 617,495 | 1/1899 | Reimann . | |
| 631,704 | 8/1899 | Elloitt et al. | 222/383.1 |
| 731,033 | 6/1903 | Freeman | 222/383.1 X |
| 1,117,729 | 11/1914 | Ward | 239/333 X |
| 1,580,246 | 4/1926 | Heller | 239/333 |
| 1,979,014 | 10/1934 | Schleif . | |
| 3,184,123 | 5/1965 | Willshaw | 239/333 |
| 3,973,700 | 8/1976 | Schmidt et al. . | |
| 4,025,045 | 5/1977 | Kubiak . | |
| 4,155,487 | 5/1979 | Blake . | |
| 4,225,061 | 9/1980 | Blake et al. . | |
| 4,310,107 | 1/1982 | Wesner . | |
| 4,819,835 | 4/1989 | Tasaki | 239/333 X |
| 5,152,461 | 10/1992 | Proctor . | |
| 5,257,724 | 11/1993 | Steijns | 222/383.1 X |
| 5,297,701 | 3/1994 | Steijns et al. . | |
| 5,303,867 | 4/1994 | Peterson . | |
| 5,335,858 | 8/1994 | Dunning et al. . | |
| 5,341,965 | 8/1994 | Maas et al. . | |
| 5,390,829 | 2/1995 | Saito et al. | 222/321.8 |

FOREIGN PATENT DOCUMENTS

| | | | |
|---|---|---|---|
| 14694XII | 3/1956 | Germany . | |
| 2079 | of 1895 | United Kingdom | 222/383.1 |

*Primary Examiner*—Andres Kashnikow
*Assistant Examiner*—Kenneth Bomberg
*Attorney, Agent, or Firm*—Howell & Haferkamp, L.C.

[57] ABSTRACT

A trigger sprayer comprises a dispenser body, a pump mechanism adjacent the dispenser body, and a trigger adjacent the pump mechanism. The pump mechanism including a pump element moveable relative to the dispenser body between first and second positions. The trigger is connected to the pump element and moveable between first and second positions wherein movement of the trigger to its first position causes movement of the pump element to its first position and movement of the trigger to its second position causes movement of the pump element to its second position. The trigger sprayer is configured so that a first application of force by a user is needed to move the trigger from the first position to the second position and a second application of force by a user is needed to move the trigger from the second position to the first position. The trigger has first and second finger engaging portions and a finger receiving opening for receiving at least one finger of a user. The finger receiving opening is at least partially defined by the first and second finger engaging portions. The finger engaging portions are configured and positioned so that pushing against the first finger engaging portion in a first direction moves the trigger toward its first position and pushing against the second finger engaging portion in a second direction opposite the first direction moves the trigger toward its second position.

19 Claims, 3 Drawing Sheets

IMPROVED TRIGGER MECHANISM FOR TRIGGER SPRAYER

BACKGROUND OF THE INVENTION

This invention relates to a liquid dispenser and more particularly to a pump-type trigger sprayer.

A trigger sprayer typically includes a dispenser body having a manually operated pump which draws liquid from a source of liquid (e.g., a container) and dispenses it through a nozzle via a liquid flow path in the dispenser body. A check valve within the liquid flow path and upstream of the pump permits fluid flow from the container to the pump, but checks fluid flow from the pump back to the container. Another check valve within the liquid flow path and downstream of the pump permits fluid flow from the pump to the nozzle, but checks fluid flow from the nozzle to the pump.

The pump is actuated by reciprocation of a pump element (e.g., a pump piston, bulb, or bellows) relative to the dispenser body between extended and compressed positions. A trigger is pivotally attached to the dispenser body and engages the pump element for moving the pump element from its extended position to its compressed position. Typically, a spring is positioned either within the pump or outside the pump for returning the pump element back to its extended position after the user releases the trigger.

A disadvantage associated with such a trigger sprayer is that the spring makes it difficult to recycle a spent or discarded sprayer. The spring is usually made of a non-recyclable metal whereas all other components are usually made of a recyclable polymeric material. Thus, a trigger sprayer must be disassembled and the spring removed before the polymeric components can be recycled.

Another disadvantage associated with such a trigger sprayer is the cost of the spring. Although such a trigger sprayer is of relatively low cost, the spring is typically its most expensive component. Millions of trigger sprayers are sold each year for use in dispensing a wide variety of products. Because of the large volumes sold, a savings of even one cent per trigger sprayer is significant.

SUMMARY OF THE INVENTION

Among the several objects of the present invention may be noted the provision of an improved trigger sprayer; the provision of such a trigger sprayer in which all components thereof are of a recyclable polymeric material; the provision of such a trigger sprayer which is relatively low in cost; the provision of such a trigger sprayer which does not need a spring or other biasing element to facilitate movement of a pump element to an extended position; and the provision of such a dispenser which is of relatively simple construction.

Generally, a trigger sprayer of the present invention comprises a dispenser body, a pump mechanism adjacent the dispenser body, and a trigger adjacent the pump mechanism. The dispenser body has an intake port adapted for fluid communication with a source of liquid, an intake liquid flow path providing fluid communication between the intake port and the pump mechanism, a discharge port, and a discharge liquid flow path providing fluid communication between the pump mechanism and discharge port. The pump mechanism including a pump element moveable relative to the dispenser body between first and second positions. The trigger is connected to the pump element and moveable between first and second positions wherein movement of the trigger to its first position causes movement of the pump element to its first position and movement of the trigger to its second position causes movement of the pump element to its second position.

The trigger sprayer is configured so that a first application of force by a user is needed to move the trigger from the first position to the second position and a second application of force by a user is needed to move the trigger from the second position to the first position. The trigger has first and second finger engaging portions and a finger receiving opening for receiving at least one finger of a user. The finger receiving opening is at least partially defined by the first and second finger engaging portions. The finger engaging portions are configured and positioned so that pushing against the first finger engaging portion in a first direction moves the trigger toward its first position and pushing against the second finger engaging portion in a second direction opposite the first direction moves the trigger toward its second position.

In another aspect of the present invention, a trigger sprayer comprises a dispenser body, a pump mechanism adjacent the dispenser body, and a trigger adjacent the pump mechanism. The trigger has first and second concave finger-engageable surface portions. The dispenser body has an intake port adapted for fluid communication with a source of liquid, an intake liquid flow path providing fluid communication between the intake port and the pump mechanism, a discharge port for dispensing of liquid in a generally forward direction, and a discharge liquid flow path providing fluid communication between the pump mechanism and discharge port. The pump mechanism includes a pump element moveable relative to the dispenser body between first and second positions. The trigger is connected to the pump element and moveable between forward and rearward positions wherein movement of the trigger to its forward position causes movement of the pump element to its first position and movement of the trigger to its rearward position causes movement of the pump element to its second position. The trigger sprayer is configured so that application of a force by a user in a forward direction is needed to move the trigger from its rearward position to its forward position and application of a force by a user in a rearward direction is needed to move the trigger from its forward position to its rearward position. The first concave finger-engageable surface portion of the trigger faces generally forwardly and is configured for engagement with a palmar side of a user's finger. The second concave finger-engageable surface portion faces generally rearwardly and is configured for engagement with a dorsal side of a user's finger. The first and second surface portions are configured so that rearwardly pushing against the first surface portion with a palmar side of a user's finger moves the trigger toward its rearward position and forwardly pushing against the second surface portion with a dorsal side of a user's finger moves the trigger toward its forward position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
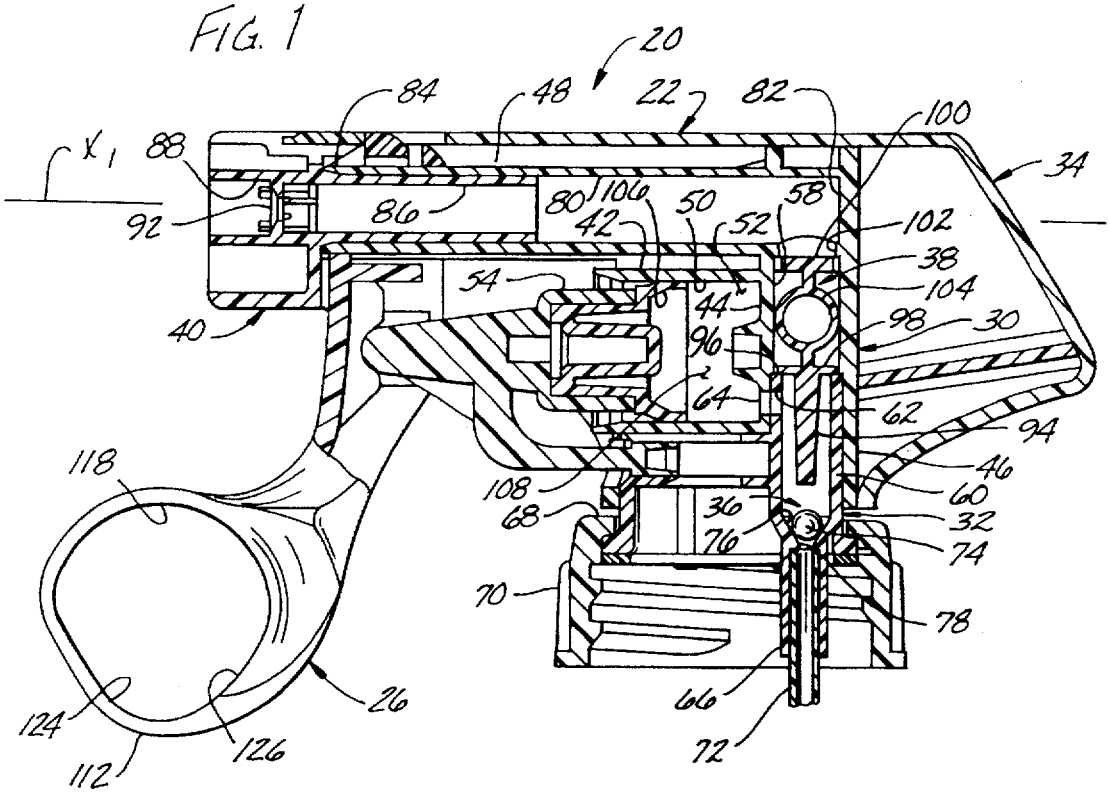
FIG. 1 is a side elevational view, in section, of a trigger sprayer of the present invention.
Figure 2:
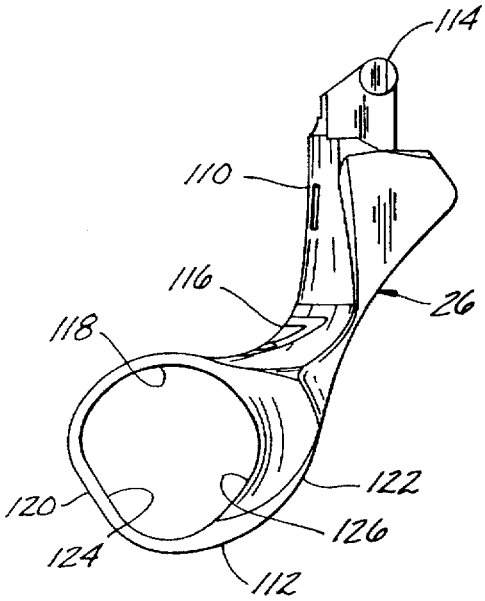
FIG. 2 is a side elevational view of the trigger of the sprayer of FIG. 1, removed from the sprayer.
Figure 3:
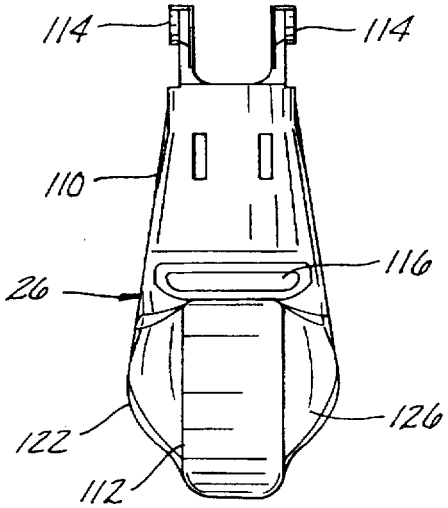
FIG. 3 is a front elevational view of the trigger of FIG. 2.
Figure 4:
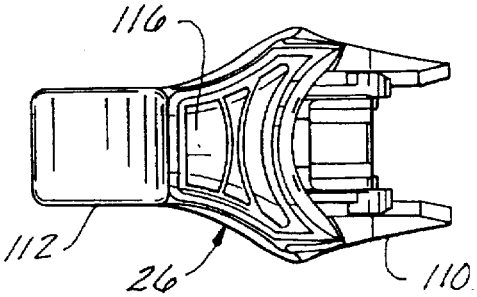
FIG. 4 is a top plan view of the trigger of FIG. 2.

Referring now to the drawings, and first more particularly to FIG. 1, a trigger sprayer of the present invention is indicated in its entirety by the reference numeral 20. The trigger sprayer 20 comprises a dispenser body, generally indicated at 22, a pump mechanism, generally indicated at 24, and a trigger, generally indicated at 26. The dispenser body 22 comprises an upper housing member, generally indicated at 30, a lower housing member, generally indicated at 32, a shroud, generally indicated at 34 surrounding the upper housing member, a first check valve, generally indicated at 36, a second check valve, generally indicated at 38, and a nozzle head, generally indicated at 40. Preferably, each of these components is of a polymeric material. More preferably, each component is of a recyclable polymeric material.

The upper housing member 30 of the dispenser body 22 includes a cylindric formation (wall) 42, a disc-shaped back wall 44 substantially closing one end (i.e., the right end as viewed in FIG. 1) of the cylindric wall, a generally cylindric vertical formation 46 adjacent the circular back wall, and a horizontal tubular portion 48 extending forward from the vertical formation. The cylindric wall 42 includes a generally cylindric inner surface 50. The inner surface 50 of the cylindric wall 42 and the disc-shaped back wall 44 define a pump chamber 52 open at one end (i.e., its left end as viewed in FIG. 1) for slidably receiving a pump piston 54. The pump chamber 52 and pump piston 54 constitute components of the pump mechanism 24.

The vertical formation 46 of the upper housing member 30 has a vertical bore 58 extending upward from the bottom of the vertical formation 46. A lower end of the vertical bore 58 receives the lower housing member 32 of the dispenser body 22. More particularly, the lower housing member 32 has a generally cylindric column 60 extending upward into the vertical bore 58 in sealing engagement with the vertical formation 46. A lateral opening 62 through the wall of the cylindric column 60 is aligned with an opening 64 through the disc-shaped back wall 44 of the upper housing member 30 to provide fluid communication between the inside of the cylindric column and the pump chamber 52. The lower housing member 32 also has a nipple 66 extending down from the lower end of the cylindric column 60, and an annular flange 68.

Preferably a threaded collar 70 (or cap) is retained on the lower housing member 32 via the annular flange 68 for receiving a threaded neck of a liquid bottle (not shown). A dip tube 72 is sealingly press fit into the nipple 66 and depends therefrom. The dip tube 72 is adapted to extend downward into liquid (not shown) within the bottle. The dip tube 72 constitutes a conduit for transporting liquid from the bottle upward into the dispenser body 22. Although the sprayer 20 preferably has a generally straight dip tube extending down into a bottle, it is to be understood that a long flexible tube could alternatively extend from the lower housing member 32 to a source of liquid remote from the sprayer.

The first (intake) check valve 36 comprises a ball 74, an annular valve seat 76 formed at the lower end of the cylindric column 60, and an opening 78 defined by the valve seat. The ball 74 of the check valve 36 is moveable between an open position (shown in phantom in FIG. 1) and a closed position (shown in solid in FIG. 1). In its open position, the ball 74 is spaced above the valve seat 76 to permit liquid to flow upward through the dip tube 72 and around the ball, and then into the pump chamber 52 via the cylindric column 60 and aligned openings 62, 64. The cylindric column 60 and aligned openings 62, 64 constitute an intake liquid flow path, and the opening 78 constitutes an intake port (also indicated at 78) for the intake liquid flow path. In its closed position, the ball 74 seals against the valve seat 76 to plug the intake port 74 and thereby check fluid flow from the pump chamber 52 to the intake port 74.

The horizontal tubular portion 48 of the upper housing member 30 includes a horizontal bore 80 extending along an axis $X_1$ between a rear portion 82 and a forward end 84 of the upper housing member. The upper end of the vertical formation 46 opens into the horizontal bore 80. The nozzle head 40 comprises a tubular projection 86 inserted into the horizontal bore 80 via the forward (downstream) end of the bore, a nozzle wall 88 at a forward end of the tubular projection 86, and a nozzle orifice 92 through the nozzle wall and in fluid communication with the interior of the bore. The upper region of the vertical bore 58, the horizontal bore 80, and the interior of the tubular projection 86 constitute a discharge liquid flow path. The nozzle orifice 92 constitutes a discharge port of the discharge liquid flow path. Dispensed liquid flows from the pump chamber 52, through the aligned openings 62, 64, upward through the vertical bore 58, forward through the horizontal bore 80, and then out through the discharge port 92.

The second (discharge) check valve 38 is positioned in the vertical bore 58 and comprises a valve body 94 and an annular valve seat 96 formed at the upper end of the cylindric column 60. The valve body comprises a disc-shaped lower plate 98 sized for covering the valve seat 96, an upper plate 100 sized for engaging an annular flange 102 extending radially inwardly from an upper end of the vertical formation 46, and a flat resilient ring 104 extending vertically between the upper and lower plates. The lower plate 98 is moveable between a closed position (shown in solid in FIG. 1) in which it seats against the valve seat 96, and an open position (not shown) in which it is positioned above the valve seat to permit liquid to flow upward through the valve seat and around the lower plate. The resilient ring 104 functions as a spring to bias the lower plate 98 in its closed position. Preferably, the upper plate 100 has a scalloped edge to permit liquid to flow upward between the flange 102 and upper plate 100 and into the horizontal bore 80. The discharge check valve 38 permits fluid flow downstream from the pump chamber 52 to the discharge port 92 and checks fluid flow from the discharge port to the pump chamber.

The pump piston 54 has a piston head 106 preferably formed of a suitable resilient material such as low density polyethylene. The piston head 106 comprises the rearward end (the right most end as viewed in FIG. 1) of the pump piston 54. The piston head 106 is slidable within the pump chamber 52 and configured for sealing engagement with the cylindric inner surface 50 of the pump chamber 52 all around the piston head 106 to seal against leakage of fluid between the pump piston 54 and cylindric inner surface 50. The piston head 106 and pump chamber 52 define a variable volume fluid receiving cavity 108. The pump piston 54 is reciprocally slidable in the pump chamber 52 between a forward (extended) position and a rearward (compressed) position. When the pump piston 54 is in its extended position (shown in FIG. 1), the fluid receiving cavity 108 has a first (extended) volume. When the pump piston 54 is in its compressed position (not shown), the fluid receiving cavity 108 has a second (compressed) volume which is smaller than the extended volume. After the pump has been primed, i.e., after air has been vented from the fluid receiving cavity 108, forward movement of the pump piston 54 creates vacuum pressure (i.e., negative pressure) in the fluid receiving cavity. This vacuum pressure causes liquid to be drawn from the bottle into the fluid receiving cavity 108 via the dip tube 72, intake port 78, and intake liquid flow path. Rearward movement of the pump piston 54 increases the pressure in the fluid receiving cavity 108. This increase in fluid pressure closes the intake check valve 36, opens the discharge check valve 38, and forces liquid out the discharge port 92 via the discharge liquid flow path.

The pump piston 54 is moved from its extended position to its compressed position by the trigger 26. The trigger 26 is connected at its upper end to the upper housing member 30 for pivotal movement relative to the upper housing member (i.e., clockwise and counterclockwise movement as viewed in FIG. 1). The trigger 26 is connected to a forward end 122 (i.e., the left most end as viewed in FIG. 1) of the pump piston 54. Counterclockwise movement of the trigger 26 causes the pump piston 54 to move rearwardly (i.e., from left to right as viewed in FIG. 1).

The trigger sprayer 20 is configured so that application of force by a user in a rearward direction (i.e., from left to right as viewed in FIG. 1) is needed to move the trigger 26 from its forward position (shown in solid in FIG. 1) to its rearward position (not shown). This is accomplished by a user squeezing the trigger 26. The trigger sprayer 20 is also configured so that application of a force by the user in a forward direction (i.e., from right to left as viewed in FIG. 1) is needed to move the trigger 26 from its rearward position to its forward position. In other words, the user must manually push the trigger 26 to its forward position. Unlike, conventional trigger sprayers, the trigger sprayer 20 does not have a biasing spring or any other biasing element to move the pump piston 54 and trigger 26 to their forward positions. Thus, the pump piston 54 is rearwardly moved from its extended position to its compressed position by manually squeezing (i.e., pulling) the trigger 26, and is returned to its extended position by manually pushing the trigger.

Referring now to FIGS. 1–4, the trigger 26 includes a trigger body 110 and a closed continuous loop 112 (or ring) formed generally at the lower end of the trigger body. The trigger body 110 preferably has laterally extending trunnions 114 (FIGS. 2 and 3) at its upper end which are engageable with trunnion receiving slots (not shown) in the upper housing member 30 for pivotal connection to the upper housing member. The trigger 26 is configured for being engaged by two fingers (e.g., index and middle fingers) of a user. The trigger body 110 has a concave index finger receiving surface (indentation) 116 above the trigger loop 112 and facing generally forwardly. The loop 112 defines a finger receiving opening 118 for receiving at least one of the user's fingers (e.g., the user's middle finger). The loop 112 comprises first (forward) and second (rearward) finger engaging portions 120, 122. The forward finger engaging portion 120 has a first concave finger-engageable surface portion 124 which faces generally rearwardly for being engaged by a dorsal (back) side of the user's finger (not shown). The rearward finger engaging portion 122 has a second concave finger-engageable surface portion 126 which faces generally forwardly for being engaged by a palmar (front) side of the user's finger. To move the trigger 26 toward its forward position, the user pushes against the rearwardly facing finger-engageable surface portion 124 with the dorsal side of one of his/her fingers (i.e., applies a forwardly directed finger pressure or force). To move the trigger 26 toward its rearward position, the user pushes against the forwardly facing finger-engageable surface portion 126 with the palmar side of the same finger or of another of his/her fingers (i.e., applies a rearwardly directed finger pressure or force). Thus, the user can easily return the trigger 26 and pump piston 54 to their forward positions without the need of any assistance from a biasing element.

Although the trigger body 110 is shown and described as having a particular configuration and as having specific features, it is to be understood that other trigger bodies of very different configurations and features could be employed without departing from the scope of this invention.

Figure 5:
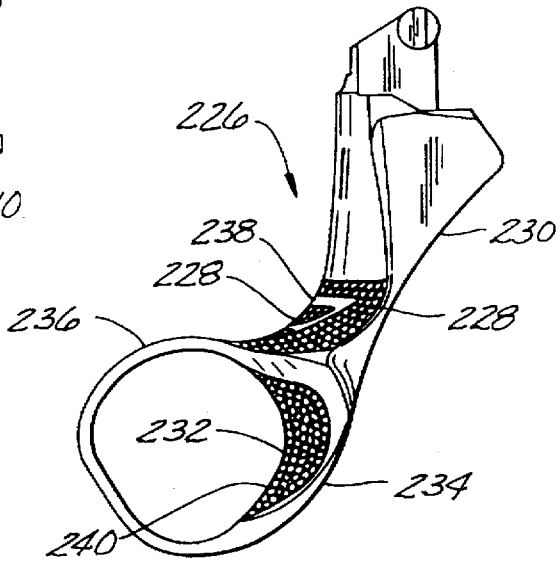
FIG. 5 is a side elevational view of an alternative trigger similar to the trigger of FIGS. 2–4 but having elastomeric gripping members.

Referring now to FIG. 5, another embodiment of a trigger of the present invention is generally indicated at 226. The trigger 226 is similar to the trigger 26 of FIGS. 1–4 except this trigger has a first (upper) elastomeric gripping element (layer) 228 inserted into a recess formed in the trigger body 230, and a second (lower) elastomeric gripping element 232 inserted into a recess formed in the rearward finger engaging portion 234 of the trigger loop 236. The first elastomeric gripping element 228 comprises a concave index finger receiving surface 238, and the second elastomeric gripping element 232 comprises a forwardly facing finger-engageable surface portion 240. The gripping elements 228, 232 are formed of a polymeric material which is more pliable (i.e., softer) than the relatively rigid polymeric material of the rest of the trigger 226. In other words, the gripping elements 228, 232 are formed of a material having a durometer hardness reading which is less than the durometer hardness reading of the main part of the trigger 226. Also, each gripping element 228, 232 preferably has a textured (roughened) surface for providing a non-slip surface.

Figure 6:
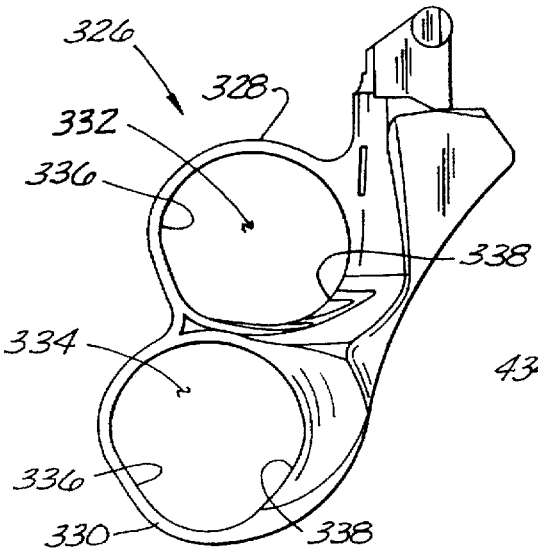
FIG. 6 is a side elevational view of another alternative trigger having two loops defining first and second finger engaging holes.

Referring now to FIG. 6, another embodiment of a trigger of the present invention is generally indicated at 326. The trigger 326 is similar to the trigger of FIGS. 1–4 except the trigger has first (upper) and second (lower) loops (rings) 328, 330 defining upper and lower finger receiving openings 332, 334 for receiving two of the user's fingers (e.g., the user's index and middle fingers). Each loop 328, 330 includes a first concave finger-engageable surface portion 336 which faces generally rearwardly, and a second concave finger-engageable surface portion 338 which faces generally forwardly. The first finger-engageable surface portions 336 are configured for being engaged by dorsal (back) sides of the user's fingers (not shown) as the user pushes the trigger 326 forwardly. The second finger-engageable surface portions 338 are configured for being engaged by palmar (front) sides of the user's fingers as the user squeezes or pushes the trigger 326 rearwardly.

Figure 7:
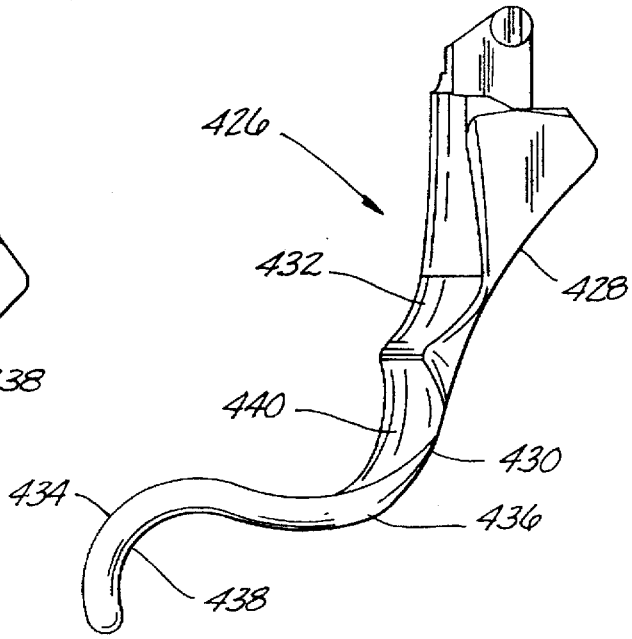
FIG. 7 is a side elevational view of another alternative trigger which is generally S-shaped.

Another embodiment of a trigger for a trigger sprayer of the present invention is generally indicated at 426 in FIG. 7. The trigger 426 is connectable to a dispenser body (not shown) and functions substantially in the same manner as the trigger 26 of FIGS. 1–4. It has a trigger body 428 and an S-shaped portion 430 extending generally from the bottom of the trigger body. The trigger body 428 is similar to the trigger body 110 shown in FIGS. 1–4 and has a concave index finger receiving surface 432 facing generally forwardly for being engaged by an index finger of the user. The S-shaped portion 430 has lower and upper bights (bends) 434, 436. The lower bight 434 has a first concave finger-engageable surface portion 438 which faces generally rearwardly for being engaged by a dorsal (back) side of a finger (e.g., a ring finger) of the user. The upper bight 436 has a second concave finger-engageable surface 440 portion which faces generally forwardly for being engaged by a palmar (front) side of a finger (e.g., a middle finger) of the user. To move the trigger 426 toward its rearward position, the user pushes against the forwardly facing finger-engageable surface portion 440 with the palmar side of his/her middle finger (i.e., applies a rearwardly directed finger pressure or force). To move the trigger 426 toward its forward position, the user pushes against the rearwardly facing finger-engageable surface portion 438 with the dorsal side of his/her ring finger (i.e., applies a forwardly directed finger pressure or force). Thus, the user can easily return the trigger 426 and pump piston (not shown) to their forward positions without the need of any assistance from a biasing element.

Figure 8:
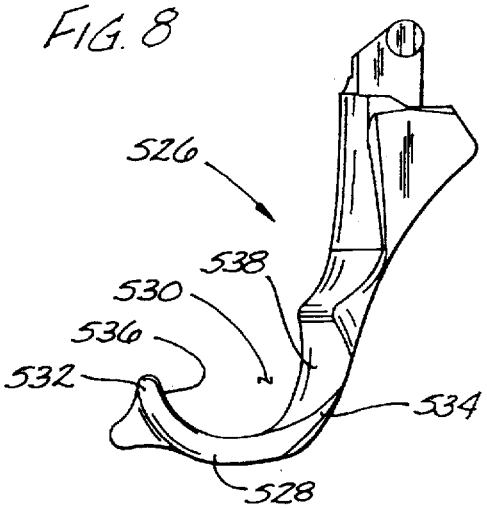
FIG. 8 is a side elevational view of another alternative trigger which is similar to the trigger of FIGS. 2–4, but which includes an incomplete (unclosed) loop.

Another embodiment of a trigger for a trigger sprayer of the present invention is generally indicated at 526 in FIG. 8. The trigger 526 is similar to the trigger 26 of FIGS. 1–4 but it has a loop 528 which is not closed. The loop 528 defines a finger receiving opening 530 for receiving at least one of the user's fingers (e.g., the user's middle finger). The loop 528 comprises first (forward) and second (rearward) finger engaging portions 532, 534. The forward finger engaging portion 532 has a first concave finger-engageable surface portion 536 which faces generally rearwardly for being engaged by a dorsal (back) side of the user's finger. The rearward finger engaging portion 534 has a second concave finger-engageable surface portion 538 which faces generally forwardly for being engaged by a palmar (front) side of the user's finger. The trigger 526 also includes a protrusion 540 which has a concave finger-engageable surface portion 542 which faces generally rearwardly for being engaged by the dorsal side of the user's ring finger.

To move the trigger 526 toward its forward position, the user pushes against the rearwardly facing finger-engageable surface portions 536, 540 with the dorsal side of his/her fingers (i.e., applies a forwardly directed finger pressure or force). To move the trigger 526 toward its rearward position, the user pushes against the forwardly facing finger-engageable surface portion 538 with the palmar side of the same finger or of another of his/her fingers (i.e., applies a rearwardly directed finger pressure or force). Thus, the trigger 526 of FIG. 8 operates in substantially the same manner as the trigger 26 of FIGS. 1–4.

Figure 9:
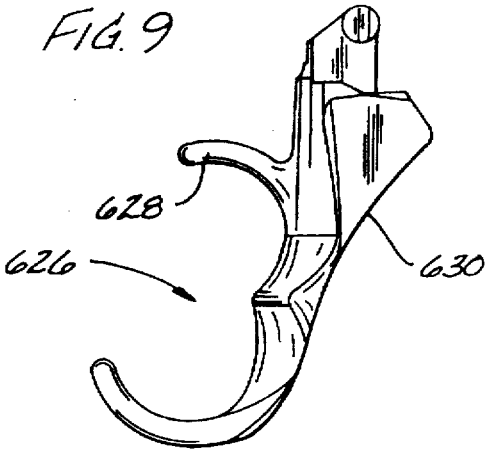
FIG. 9 is a side elevational view of another alternative trigger which is similar to the trigger of FIG. 8 but further includes a forwardly projecting hook for engaging an index finger of a user.

Referring now to FIG. 9, another embodiment of a trigger for a trigger sprayer of the present invention is generally indicated at 626. The trigger 626 of FIG. 9 is similar to the trigger of FIG. 8 but further includes a hook 628 projecting forwardly from the trigger body 630. The hook 628 is configured for engaging the dorsal side of a user's index finger as the user pushes the trigger forwardly.

Figure 10:
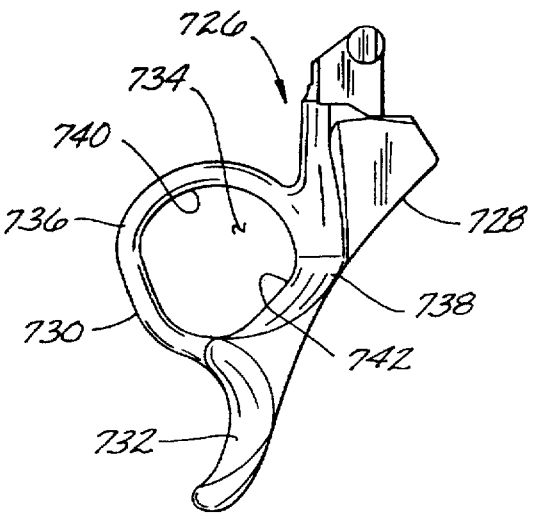
FIG. 10 is a side elevational view of another alternative trigger similar to the trigger of FIG. 6 but having only one loop and a forwardly facing middle-finger engaging surface below the loop for engaging a middle finger of a user.

Another embodiment of a trigger of the present invention is generally indicated at 726 in FIG. 10. The trigger 726 has a trigger body 728 similar to the trigger body of the trigger 326 of FIG. 6. It also includes a loop 730 and a forwardly facing middle-finger engaging surface 732 below the loop. The loop 730 defines a finger receiving opening 734 for receiving at least one of the user's fingers (e.g., the user's index finger). The loop 730 comprises forward and rearward finger engaging portions 736, 738. The forward finger engaging portion 736 has a first concave finger-engageable surface portion 740 which faces generally rearwardly for being engaged by a dorsal (back) side of the user's index finger as the trigger 726 is moved forwardly. The rearward finger engaging portion 738 has a second concave finger-engageable surface portion 742 which faces generally forwardly for being engaged by a palmar (front) side of the user's index finger as the trigger 726 is moved rearwardly. The middle-finger engaging surface 732 is configured for being engaged by the middle finger of the user as the trigger 726 is moved rearwardly.

Figure 11:
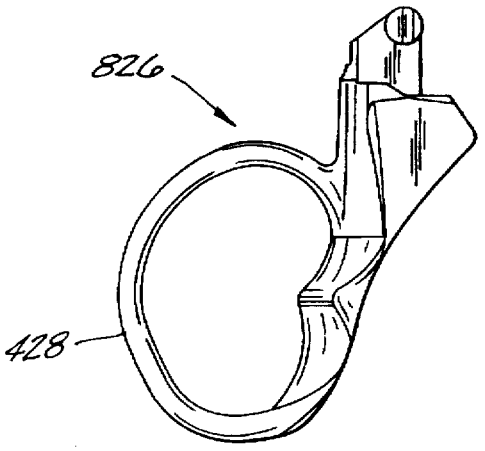
FIG. 11 is a side elevational view of another alternative trigger similar to the trigger of FIG. 6 but having only one loop which is shaped and configured for receiving two fingers of a user.

Referring now to FIG. 11, another embodiment of a trigger of the present invention is generally indicated at 826. The trigger 826 has a relatively large closed loop 828 for receiving two fingers (e.g., index and middle fingers) of the user. This trigger 826 operates in substantially the same manner as the trigger 326 of FIG. 6.

Because of the shape and configuration of the various triggers shown in FIGS. 1–11, a user can easily apply finger pressure to move any one of them to its forward position to return a corresponding pump piston to its extended position. Thus, it is unnecessary for the sprayer to have a return spring or any other means for returning a trigger to its forward position. Accordingly, every component of trigger sprayers incorporating the above-described features can be of relatively inexpensive and recyclable polymeric materials.

Although several alternative embodiments of triggers have been shown or described, it is to be understood that triggers of other shapes and configurations may be employed without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. It is intended that the invention shall be limited solely by the scope of the claims.

What is claimed is:

1. A trigger sprayer comprising:

a dispenser body;

a pump mechanism adjacent the dispenser body; and a trigger adjacent the pump mechanism, said trigger having first and second concave finger-engageable surface portions;

the dispenser body having an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port for dispensing of liquid in a generally forward direction, and a discharge liquid flow path providing fluid communication between the pump mechanism and discharge port;

the pump mechanism including a pump element moveable relative to the dispenser body between first and second positions;

the trigger being connected to the pump element and moveable between forward and rearward positions wherein movement of the trigger to its forward position causes movement of the pump element to its first position and movement of the trigger to its rearward position causes movement of the pump element to its second position, the trigger being of first and second polymeric parts, the first polymeric part being of a material which is more pliable than the second polymeric part;

the trigger sprayer being configured so that application of a force by a user in a forward direction is needed to move the trigger from its rearward position to its forward position and application of a force by the user in a rearward direction is needed to move the trigger from its forward position to its rearward position;

said first concave finger-engageable surface portion of the trigger facing generally forwardly and configured for engagement with a palmar side of a user's finger, said second concave finger-engageable surface portion facing generally rearwardly and configured for engagement with a dorsal side of a user's finger, said first and second surface portions being configured so that rearwardly pushing against the first surface portion with a palmar side of a user's finger moves the trigger toward its rearward position and forwardly pushing against the second surface portion with a dorsal side of a user's finger moves the trigger toward its forward position.

2. A trigger sprayer as set forth in claim 1 wherein the trigger is generally S-shaped.

3. A trigger sprayer as set forth in claim 1 wherein the trigger includes a loop defining the first and second concave finger-engageable surface portions.

4. A trigger sprayer as set forth in claim 3 wherein the loop is a closed loop.

5. A trigger sprayer as set forth in claim 3 wherein the loop defines a finger receiving opening for receiving a finger of a user.

6. A trigger sprayer as set forth in claim 1 wherein at least one of the first and second concave finger-engageable surface portions is a surface of the first polymeric part.

7. A trigger sprayer comprising:

a dispenser body;

a pump mechanism adjacent the dispenser body; and a trigger adjacent the pump mechanism;

the dispenser body having an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, and a discharge liquid flow path providing fluid communication between the pump mechanism and discharge port;

the pump mechanism including a pump element moveable relative to the dispenser body between first and second positions;

the trigger being connected to the pump element and moveable between first and second positions wherein movement of the trigger to its first position causes movement of the pump element to its first position and movement of the trigger to its second position causes movement of the pump element to its second position;

the trigger sprayer being configured so that a first application of force by the user is needed to move the trigger from the first position to the second position and a second application of force by the user is needed to move the trigger from the second position to the first position;

the trigger having first and second finger engaging portions and a finger receiving opening for receiving at least one finger of a user, said finger receiving opening being at least partially defined by the first and second finger engaging portions, the finger engaging portions being configured and positioned so that pushing against the first finger engaging portion in a first direction moves the trigger toward its first position and pushing against the second finger engaging portion in a second direction opposite said first direction moves the trigger toward its second position, the trigger being of first and second polymeric parts, the first polymeric part being of a material which is more pliable than the second polymeric part.

8. A trigger sprayer as set forth in claim 7 wherein the first concave finger-engageable surface portion is a surface of the first polymeric part.

9. A trigger sprayer comprising:

a dispenser body;

a pump mechanism adjacent the dispenser body; and a trigger adjacent the pump mechanism;

the dispenser body having an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, and a discharge liquid flow path providing fluid communication between the pump mechanism and discharge port;

the pump mechanism including a pump element moveable relative to the dispenser body between first and second positions;

the trigger being connected to the pump element and moveable between first and second positions wherein movement of the trigger from its first position to its second position causes movement of the pump element from its first position to its second position, the trigger being of first and second polymeric parts, the first polymeric part being of a material which is more pliable than the second polymeric part.

10. A trigger sprayer as set forth in claim 9 wherein the trigger is pivotally connected to the dispenser body.

11. A trigger sprayer as set forth in claim 9 wherein the trigger includes a loop defining the finger receiving opening, the finger engaging portions constituting portions of the loop.

12. A trigger sprayer as set forth in claim 11 wherein the loop is a closed loop.

13. A trigger sprayer as set forth in claim 11 wherein the trigger includes a second loop defining a second finger receiving opening for receiving a second finger of a user.

14. A trigger sprayer as set forth in claim 13 wherein at least one of the first and second loops is a closed loop.

15. A trigger sprayer as set forth in claim 13 wherein the first and second loops are closed loops.

16. A trigger sprayer as set forth in claim 9 wherein the trigger has first and second finger engaging portions and a finger receiving opening for receiving at least one finger of a user, the finger receiving opening being at least partially defined by the first and second finger engaging portions.

17. A trigger sprayer as set forth in claim 16 wherein at least one of the first and second finger engaging portions is a surface of the first polymeric part.

18. A trigger sprayer as set forth in claim 16 wherein the first finger engaging portion includes a first concave finger-engageable surface portion which faces generally forwardly, and wherein the second finger engaging portion includes a second concave finger-engageable surface portion which faces generally rearwardly, the first concave finger-engageable surface portion is configured for engagement with a palmar side of a user's finger, said second concave finger-engageable surface portion is configured for engagement with a dorsal side of a user's finger.

19. A trigger sprayer as set forth in claim 18 wherein the first concave finger-engageable surface portion comprises a textured surface.

* * * * *